US010370903B2

(12) United States Patent
Lehr et al.

(10) Patent No.: US 10,370,903 B2
(45) Date of Patent: Aug. 6, 2019

(54) ELECTRICAL PULSE DRILL BIT HAVING SPIRAL ELECTRODES

(71) Applicants: Joerg Lehr, Lower Saxony (DE); Erik Anders, Saxony (DE)

(72) Inventors: Joerg Lehr, Lower Saxony (DE); Erik Anders, Saxony (DE)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 83 days.

(21) Appl. No.: 15/410,955

(22) Filed: Jan. 20, 2017

(65) Prior Publication Data

US 2017/0204669 A1 Jul. 20, 2017

Related U.S. Application Data

(60) Provisional application No. 62/280,842, filed on Jan. 20, 2016.

(51) Int. Cl.
*E21B 7/15* (2006.01)
*E21B 10/00* (2006.01)

(52) U.S. Cl.
CPC ..... *E21B 7/15* (2013.01); *E21B 10/00* (2013.01)

(58) Field of Classification Search
CPC ..... E21B 10/00; E21B 47/14; E21B 47/15
See application file for complete search history.

(56) References Cited

U.S. PATENT DOCUMENTS

| | | | | |
|---|---|---|---|---|
| 4,741,405 | A | 5/1988 | Moeny et al. | |
| 5,845,854 | A | 12/1998 | Adam et al. | |
| 5,896,938 | A | 4/1999 | Moeny et al. | |
| 6,164,388 | A | 12/2000 | Martunovich et al. | |
| 6,427,774 | B2 | 8/2002 | Thomas et al. | |
| 7,270,195 | B2 | 9/2007 | MacGregor et al. | |
| 7,527,108 | B2 | 5/2009 | Moeny | |
| 7,530,406 | B2 | 5/2009 | Moeny et al. | |
| 7,559,378 | B2 | 7/2009 | Moeny | |
| 7,784,563 | B2 | 8/2010 | Rodland et al. | |
| 8,172,006 | B2 | 5/2012 | Moeny | |
| 8,479,841 | B2 | 7/2013 | Rosten et al. | |
| 8,746,365 | B2 | 6/2014 | Gutsol | |
| 9,027,669 | B2 | 5/2015 | Dirksen | |
| 9,416,594 | B2 | 8/2016 | Jeffryes et al. | |
| 2006/0038045 | A1* | 2/2006 | Moeny | B23H 1/08 241/1 |
| 2006/0038437 | A1* | 2/2006 | Moeny | B23H 1/08 299/14 |
| 2010/0000790 | A1 | 1/2010 | Moeny | |
| 2010/0212962 | A1 | 8/2010 | Rosten et al. | |

(Continued)

FOREIGN PATENT DOCUMENTS

| | | | |
|---|---|---|---|
| CN | 103527077 | A | 1/2014 |
| CN | 103878459 | A | 6/2014 |

(Continued)

*Primary Examiner* — Brad Harcourt
*Assistant Examiner* — David Carroll
(74) *Attorney, Agent, or Firm* — Cantor Colburn LLP

(57) ABSTRACT

A drill bit assembly includes a drill bit body, an insulating layer disposed on an end of the drill bit body and that defines a drill bit face and two electrodes formed such that they both extend from the drill bit face. The two electrodes form a spiral on the drill bit face and are equidistant from each other at all locations of the drill bit face.

21 Claims, 9 Drawing Sheets

(56) References Cited

U.S. PATENT DOCUMENTS

| | | | | |
|---|---|---|---|---|
| 2011/0011592 | A1 | 1/2011 | Leon et al. | |
| 2013/0076262 | A1 | 3/2013 | Noguchi et al. | |
| 2013/0081874 | A1* | 4/2013 | Gutsol | E21B 7/15 175/1 |
| 2014/0008124 | A1* | 1/2014 | Ma | E21B 7/00 175/17 |
| 2014/0027178 | A1 | 1/2014 | Jeffryes et al. | |
| 2016/0024849 | A1 | 1/2016 | Kocis et al. | |
| 2017/0138129 | A1 | 5/2017 | Oles et al. | |

FOREIGN PATENT DOCUMENTS

| | | | |
|---|---|---|---|
| CN | 203738235 | U | 7/2014 |
| CN | 104201666 | A | 12/2014 |
| CN | 204024644 | U | 12/2014 |
| FR | 3017897 | A1 | 8/2015 |
| GB | 2420358 | B | 9/2008 |
| RU | 2471987 | C1 | 1/2013 |
| RU | 2477370 | C1 | 3/2013 |
| RU | 2012117948 | | 11/2013 |
| UA | 83281 | C2 | 6/2008 |
| WO | 03069110 | A1 | 8/2003 |
| WO | 2006023998 | A2 | 3/2006 |
| WO | 2008071666 | A1 | 6/2008 |
| WO | 2010027866 | A2 | 3/2010 |
| WO | 2010114415 | A1 | 10/2010 |
| WO | 2010151170 | A1 | 12/2010 |
| WO | 2014100255 | A1 | 6/2014 |

* cited by examiner

ELECTRICAL PULSE DRILL BIT HAVING SPIRAL ELECTRODES

CROSS REFERENCE TO RELATED APPLICATIONS

This application claims the benefit of an earlier filing date from U.S. Provisional Application Ser. No. 62/280,842 filed Jan. 20, 2016, the entire disclosure of which is incorporated herein by reference.

BACKGROUND

The present disclosure is related to the subterranean drilling and, more specifically, utilizing electrical impulses to break rock while drilling.

During subterranean drilling and completion operations, a pipe or other conduit is lowered into a borehole in an earth formation during or after drilling operations. Such pipes are generally configured as multiple pipe segments to form a "string", such as a drill string or production string. As the string is lowered into the borehole, additional pipe segments are coupled to the string by various coupling mechanisms, such as threaded couplings.

During drilling, a bit is coupled to a leading end of the drill string. Due to rotation of the string or the rotation of a mud motor (or both) the bit is caused to rotate and crush or otherwise break rock or other materials that it contacts. The crushed rock is then removed to the surface by a drilling fluid pumped through the drill string to region at or near the drill bit. Such drilling relies on pressure and contact between the rock and drill bit to crush/break the rock. Several different types of drill bits that can accomplish such rock breaking are known and include, for example, rolling cutter bits that drill largely by fracturing or crushing the formation with "tooth" shaped cutting elements on two or more cone-shaped elements that roll across the face of the borehole as the bit is rotated. Another type of bit is a fixed cutter bit that employs a set of blades with very hard cutting elements, most commonly natural or synthetic diamond, to remove material by scraping or grinding action as the bit is rotated.

Another approach to crushing rock includes application of high-voltage electrical pulses to the rock to crush or break the rock. One such approach causes plasma-channel formation inside the rock ahead of the drill region due the application of high voltage pulses. The extremely rapid expansion of this plasma channel within the rock, which occurs in less than a millionth of a second, causes the local region of rock to fracture and fragment. This and other approaches may include providing electrodes at the tip bottom hole assembly (BHA). The BHA includes electronics that deliver the pulses to the electrodes and the discharge that causes the rock to break occurs through the rock and/or drilling fluid between the electrodes.

Electrodes and rock have to be electrical contacted only. Less or no weight on bit is required to maintain the electrical contact and the drilling process therefore. Drilling to vertical depth deeper than 30.000 ft (10.000 m) and extreme long laterals will be enabled due to the absence of heavy weight drill pipes within the BHA. The utilization of deep high enthalpy reservoirs, as environmental friendly energy source, will be possible in the future including the build of down hole heat exchangers with multiple lateral wellbores in crystalline rock.

BRIEF DESCRIPTION

According to one embodiment, a drill bit assembly is disclosed. The assembly includes a drill bit body and an insulating layer disposed on an end of the drill bit body and that defines a drill bit face. The assembly also includes two electrodes formed such that they both extend from the drill bit face, the two electrodes forming a spiral on the drill bit face and being equidistant from each other at all locations of the drill bit face.

According to one embodiment, a drill bit assembly that includes a drill bit body and an insulating layer disposed around the drill bit body is disclosed. The assembly also includes two electrodes formed such that they both surround a radial outer surface of the insulating layer, the two electrodes forming a helical spiral shape about the radial outer surface and being equidistant from each other.

According to another embodiment, a method of drilling a borehole is disclosed. The method includes: coupling a drill bit assembly to a drill string. The assembly includes a drill bit body, an insulating layer disposed on an end of the drill bit body and that defines a drill bit face and two electrodes formed such that they both extend form the drill bit and are equidistant from each other at all locations on the drill bit. The assembly also includes a pulse generator electrically coupled to the two electrodes. The method further includes: forming a potential between the two electrodes by providing power to the pulse generator; allowing the potential to discharge through a formation at or near the drill bit face; and removing formation fragments from the borehole caused by the discharge.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed system, apparatus and method are presented herein by way of exemplification and not limitation with reference to the Figures.

As discussed above, prior electrical pulse drilling methods included electrodes between which electric potential fields were created. The fields may cause impact ionization to occur in the rock which will eventually cause the rock to break and the potential between the electrodes to discharge though the rock and cause localized rock breakage near the location between the electrodes where the breakdown occurred. That is, the location of the electrodes determined where the rock was broken and regions not between the electrodes may not be effectively broken. Disclosed herein is a system that includes a drill bit with electrodes that allow for rock breakage at different locations. As more fully disclosed below, the electrodes may be configured as spirals that are equidistant distant from each other and disposed on a leading end of a drill bit. Such a configuration may provide from more distributed electric fields and allow for improved hole cleaning in some embodiments.

Figure 1:
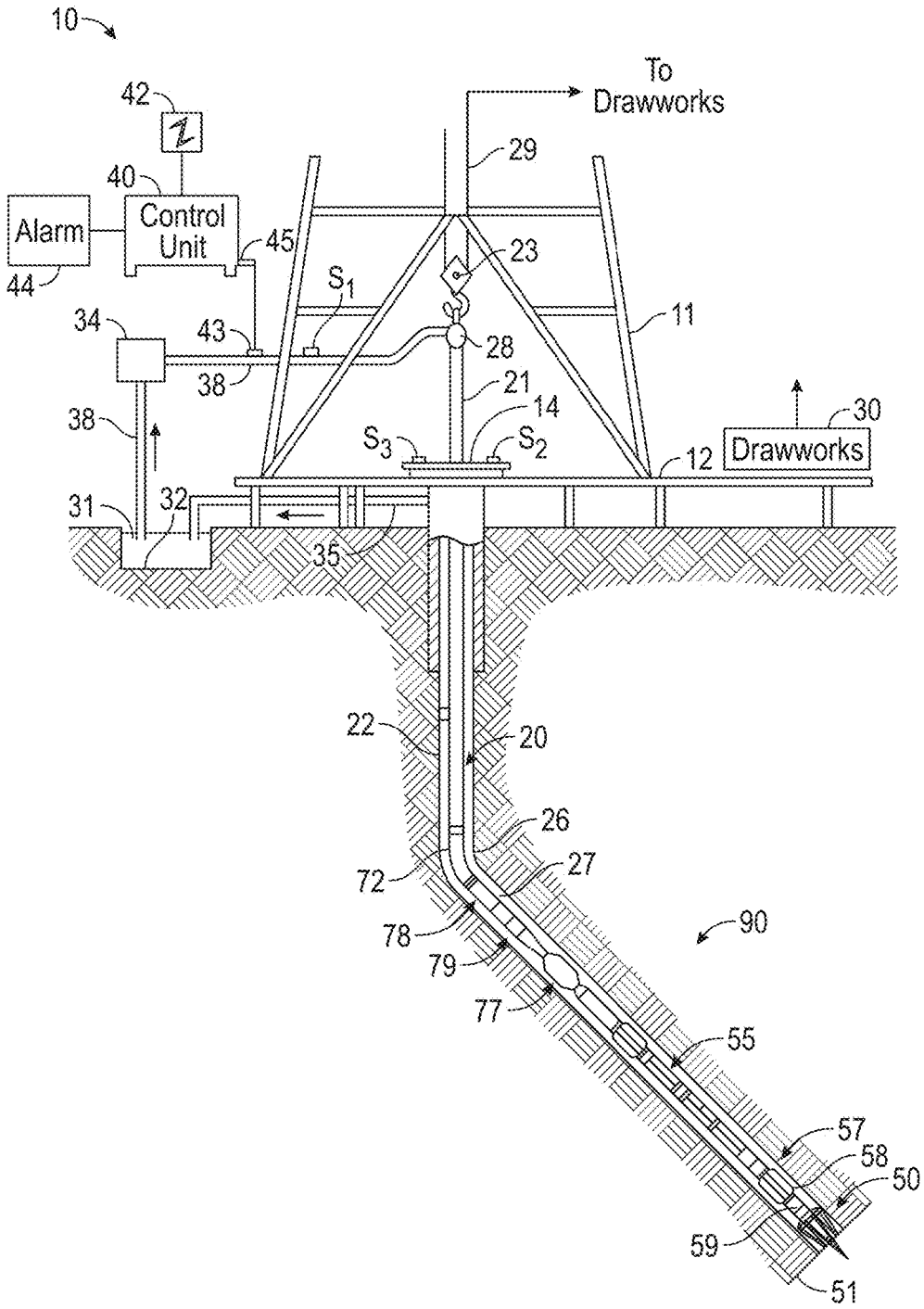
FIG. 1 shows a drilling rig that may be used to deliver and drive a drill bit to a downhole location to drill a borehole.

FIG. 1 shows a schematic diagram of a drilling system 10 with a drillstring 20 carrying a drilling assembly 90 (also referred to as the bottom hole assembly, or "BHA") conveyed in a "wellbore" or "borehole" 26 for drilling the wellbore. The drilling system 10 includes a conventional derrick 11 erected on a floor 12 which supports a rotary table 14 that is rotated by a prime mover such as an electric motor (not shown) at a desired rotational speed. The drillstring 20 includes a tubing such as a drill pipe 22 extending downward from the surface into the borehole 26. The drill bit 50 attached to the end of the drillstring breaks up the geological formations. In typical systems, rotation and pressure (e.g., weight-on-bit) causes rocks or other elements forming the formation to break when the bit is rotated to drill the borehole 26. Herein, the bit may include electrodes that cause the rock to break. In one embodiment, the bit 50 may also include blades or other elements to side cut the rock.

If a drill pipe 22 is used, the drillstring 20 is coupled to a drawworks 30 via a Kelly joint 21, swivel 28, and line 29 through a pulley 23. During drilling operations, the drawworks 30 is operated to control the weight on bit, which is an important parameter that affects the rate of penetration. The operation of the drawworks is well known in the art and is thus not described in detail herein.

During drilling operations, a suitable drilling fluid 31 from a mud pit (source) 32 is circulated under pressure through a channel in the drillstring 20 by a mud pump 34. The drilling fluid passes from the mud pump 34 into the drillstring 20 via a desurger (not shown), fluid line 38 and Kelly joint 21. The drilling fluid 31 is discharged at the borehole bottom 51 through an opening in the drill bit 50. The drilling fluid 31 circulates uphole through the annular space 27 between the drillstring 20 and the borehole 26 and returns to the mud pit 32 via a return line 35. The drilling fluid acts to lubricate the drill bit 50 and to carry borehole cutting or chips away from the drill bit 50. A sensor $S_1$ preferably placed in the line 38 provides information about the fluid flow rate. A surface torque sensor $S_2$ and a sensor $S_3$ associated with the drillstring 20 respectively provide information about the torque and rotational speed of the drillstring. Additionally, a sensor (not shown) associated with line 29 is used to provide the hook load of the drillstring 20.

In one embodiment of the disclosure, the drill bit 50 is rotated by only rotating the drill pipe 22. In another embodiment of the disclosure, a downhole motor 55 (mud motor) is disposed in the drilling assembly 90 to rotate the drill bit 50 and the drill pipe 22 is rotated usually to supplement the rotational power, if required, and to effect changes in the drilling direction.

In the embodiment of FIG. 1, the mud motor 55 is coupled to the drill bit 50 via a drive shaft (not shown) disposed in a bearing assembly 57. The mud motor rotates the drill bit 50 when the drilling fluid 31 passes through the mud motor 55 under pressure. The bearing assembly 57 supports the radial and axial forces of the drill bit. A stabilizer 58 coupled to the bearing assembly 57 acts as a centralizer for the lowermost portion of the mud motor assembly.

In one embodiment of the disclosure, a drilling sensor module 59 is placed near the drill bit 50. The drilling sensor module contains sensors, circuitry and processing software and algorithms relating to the dynamic drilling parameters. Such parameters preferably include bit bounce, stick-slip of the drilling assembly, backward rotation, torque, shocks, borehole and annulus pressure, acceleration measurements and other measurements of the drill bit condition. A suitable telemetry or communication sub 72 using, for example, two-way telemetry, is also provided as illustrated in the drilling assembly 90. The drilling sensor module processes the sensor information and transmits it to the surface control unit 40 via the telemetry system 72.

The communication sub 72, a power unit 78 and an MWD tool 79 are all connected in tandem with the drillstring 20. Flex subs, for example, are used in connecting the MWD tool 79 in the drilling assembly 90. Such subs and tools form the bottom hole drilling assembly 90 between the drillstring 20 and the drill bit 50. The drilling assembly 90 may make various measurements while the borehole 26 is being drilled. The communication sub 72 obtains the signals and measurements and transfers the signals, using two-way telemetry, for example, to be processed on the surface. Alternatively, the signals can be processed using a downhole processor in the drilling assembly 90. The telemetry system may include a wired pipe system which may be used to bi-directionally transfer data as well as transfer energy from surface to downhole in order to power the drill bit.

The surface control unit or processor 40 also receives signals from other downhole sensors and devices and signals from sensors $S_1$-$S_3$ and other sensors used in the system 10 and processes such signals according to programmed instructions provided to the surface control unit 40. The surface control unit 40 displays desired drilling parameters and other information on a display/monitor 42 utilized by an operator to control the drilling operations. The surface control unit 40 preferably includes a computer or a microprocessor-based processing system, memory for storing programs or models and data, a recorder for recording data, and other peripherals. The control unit 40 is preferably adapted to activate alarms 44 when certain unsafe or undesirable operating conditions occur.

Figure 2:
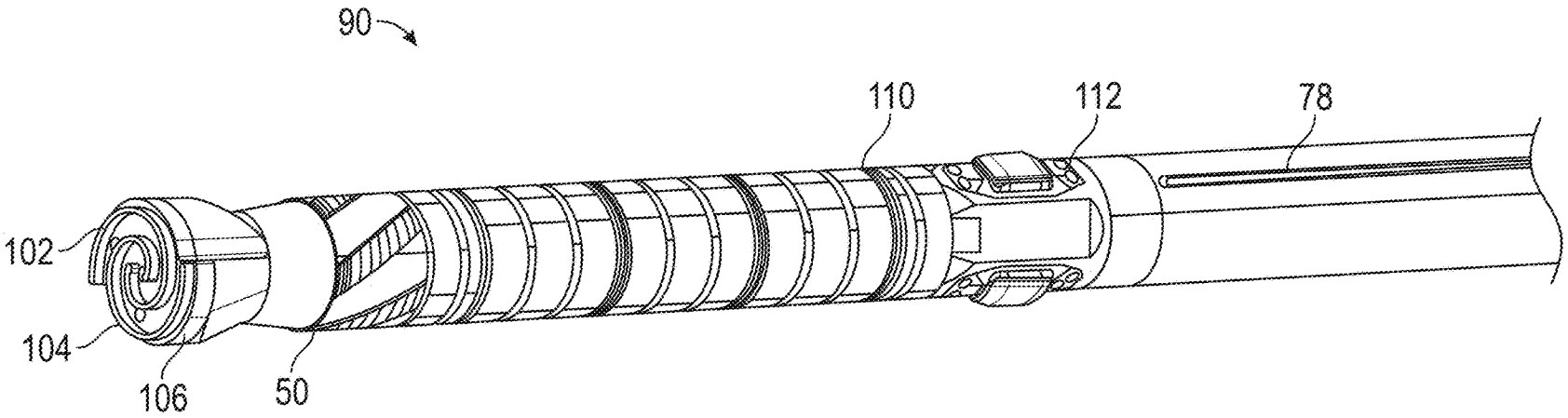
FIG. 2 is a perspective view of a portion of drill string including a drilling assembly according to one embodiment.

FIG. 2 shows an example of a portion of the BHA 90 of FIG. 1 according to one embodiment. The BHA 90 includes a drill bit 50 that breaks rock or other formations by providing high power impulses to the rock. As shown, the drill bit includes two electrodes 102, 104. As will be more fully explained below, the electrodes 102, 104 are formed as equidistant spirals separated by an isolator 106. A power supply such as power unit 78 provides power to a high voltage pulse generator 110. The power unit 78 may be part of a mud motor, a turbine or may be a battery. In one instance, the power unit 78 is a battery that is charged by a mud motor.

A high voltage pulse generator 110 (pulse generator) is electrically coupled between the power unit 78 and the electrodes 102, 104 and causes a rapid voltage to build up between the electrodes 102, 104. When the voltage reaches a threshold level, the voltage in the pulse generator 110 may discharge through the rock located between or in the vicinity of the electrodes 102, 104. It shall be understood to the skilled artisan that in this manner the electrodes 102, 104 operate as a capacitor and, as such, may be collectively referred to as a "bit capacitor" from time to time herein.

Also included in FIG. 2 is an optional steering unit 112. Such units are known in the art and not discussed further herein.

Figure 3:
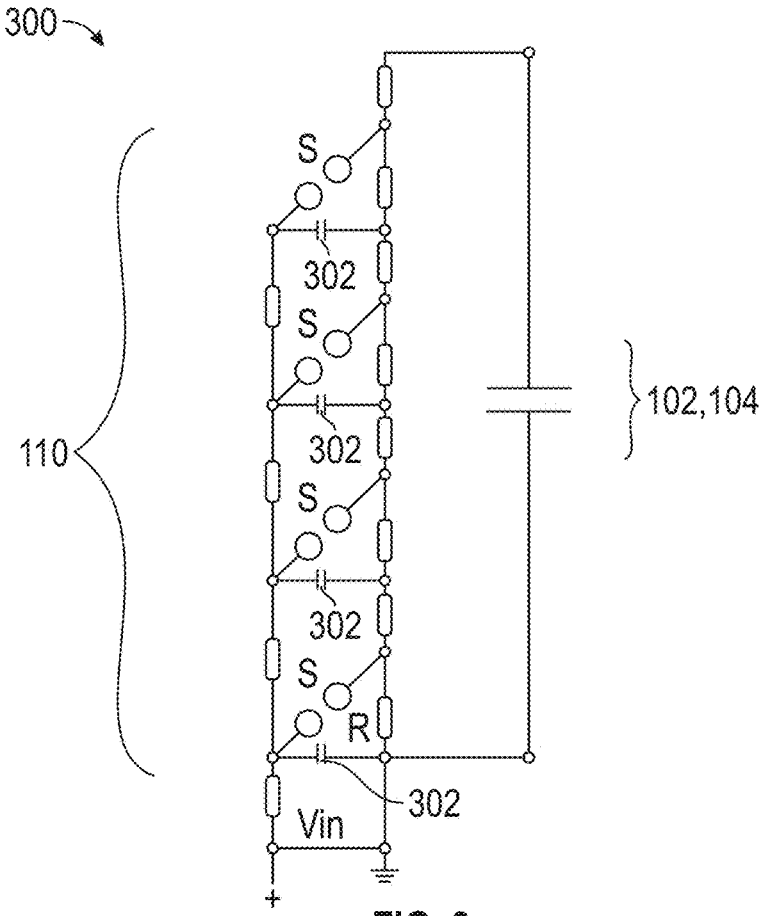
FIG. 3 is an equivalent circuit representation of a pulse generator connected to a drill bit according to one embodiment.

FIG. 3 shows an equivalent circuit 300 of an embodiment of the present invention. The circuit includes the pulse generator 110. The power unit 78 provide an input voltage Vin to the pulse generator 110. This voltage causes the one or more high voltage capacitors 302 to be charged. When the switches S are closed, the charged voltage in the capacitors 302 causes the voltage between the electrodes 102, 104 that form the bit capacitor to quickly rise and then discharge through the rock. The pulse generator 110 shown in FIG. 3 is an example only and also includes various resistors R the purpose of which the skilled artisan will understand and the values of which may be selected to cause the desired rise times of the potential between the electrodes 102, 104 described below. Other types of generators that cause a voltage between the electrodes 102, 104 to rise as described below may be utilized as the pulse generator 110 in other embodiments without departing from the teachings herein.

Figure 4A:
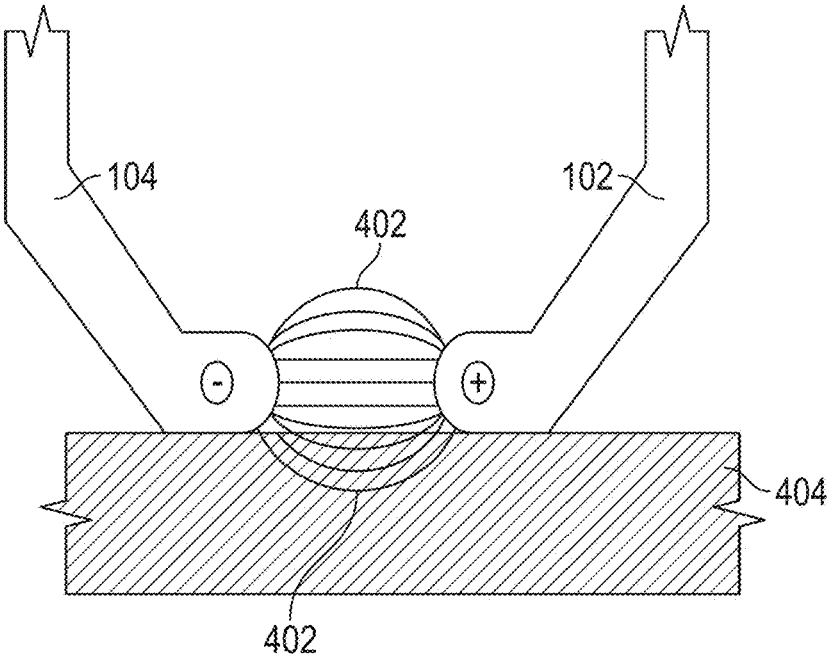
FIGS. 4*a*-4*b* show, respectively, fields that may be generated when a pulse generator provides a voltage between two electrodes contacting a formation and a rise time for the potential between the electrodes that cause discharge through rock or a fluid.
Figure 4B:
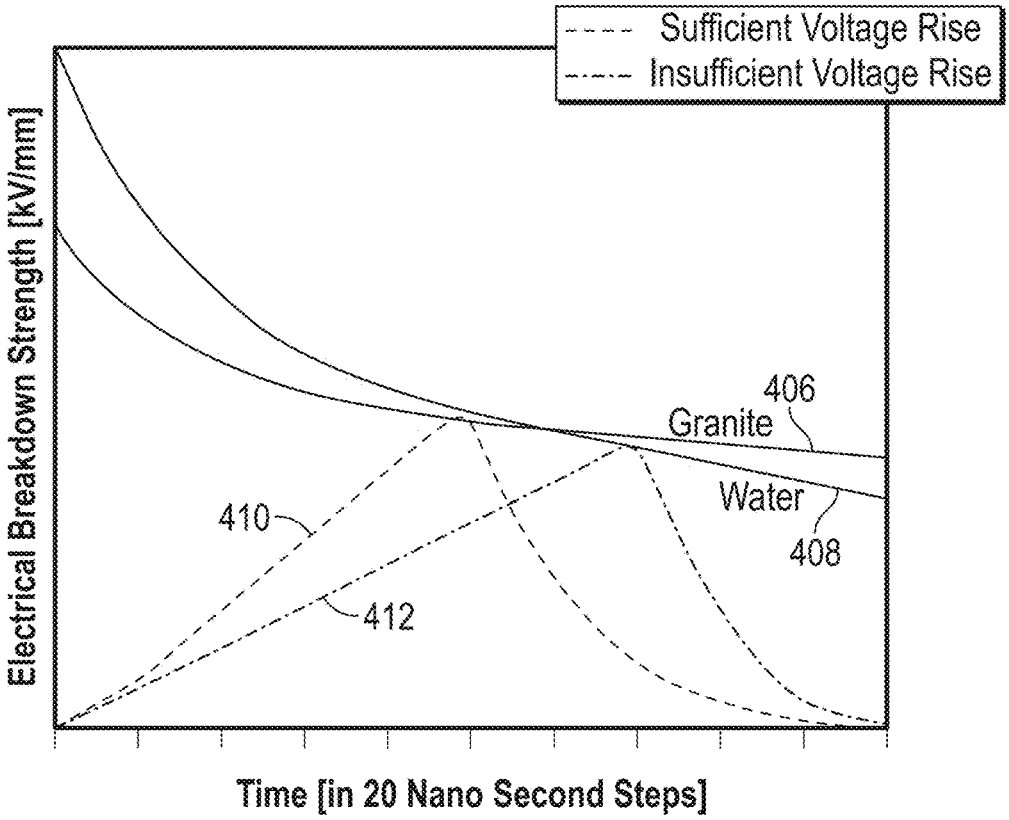

With reference now to FIG. 3 and FIGS. 4*a*-4*b*, as the pulse generator 110 is allowed to charge the capacitor formed by electrodes 102, 104 (e.g., while switches S are closed) an electric potential builds up between the electrodes 102, 104. The potential causes an electric field to develop which is illustrated in FIG. 4*a* by illustrative electric field lines. As shown, some of the electric field lines pass through the drilling mud as indicated by field lines $\mathbf{402}_{fluid}$ and another portion passes through the rock 404 as indicated by field lines $\mathbf{402}_{rock}$.

FIG. 4*b* shows a ratio for granite (curve 406) and water (curve 408) that illustrates a relationship between an electric potential rise time and breakdown strength. That is, each of curves 406 and 408 show how fast a potential has to reach a particular level in order to cause a break down through the substance. FIG. 4*b* shows that, at the extremes (e.g., the rock is granite and drilling mud is pure water) that if the rise time of the buildup in the electric field is fast enough (trace 410) the breakdown will occur through the rock, not the fluid. If it is too slow (trace 412) the breakdown will occur through the fluid, not the rock. The so called "breakdown" refers to the condition where the energy between the electrodes is allowed to pass to ground.

It shall be understood that FIGS. 3 and 4*a*-4*b* are examples only and the particular build up speeds may be different. What is needed, however, is that the pulse generator be selected such that it can build a potential between the electrodes 102, 104 fast enough that the breakdown (e.g., current discharge) occurs through the rock, not the fluid.

Given the fast rise times, to the extent rock is present between the electrodes, the breakdown (and rock destruction) will occur where rock is between or near the electrodes 102, 104. However, if only one such location is provided, it may be difficult of uniformly destroy rock. Herein, the electrodes 102, 104 are formed such the breakdown may occur at any or most locations on a face of the bit rather than a single location or several discrete locations. This may be achieved, in one embodiment, by providing spiral electrodes that are equidistant from each other on the face of the bit. Any of the electrodes described herein may individually be formed as bifilar coil. Alternatively, the electrodes 102, 104 may collectively form a bifilar coil.

Figure 5:
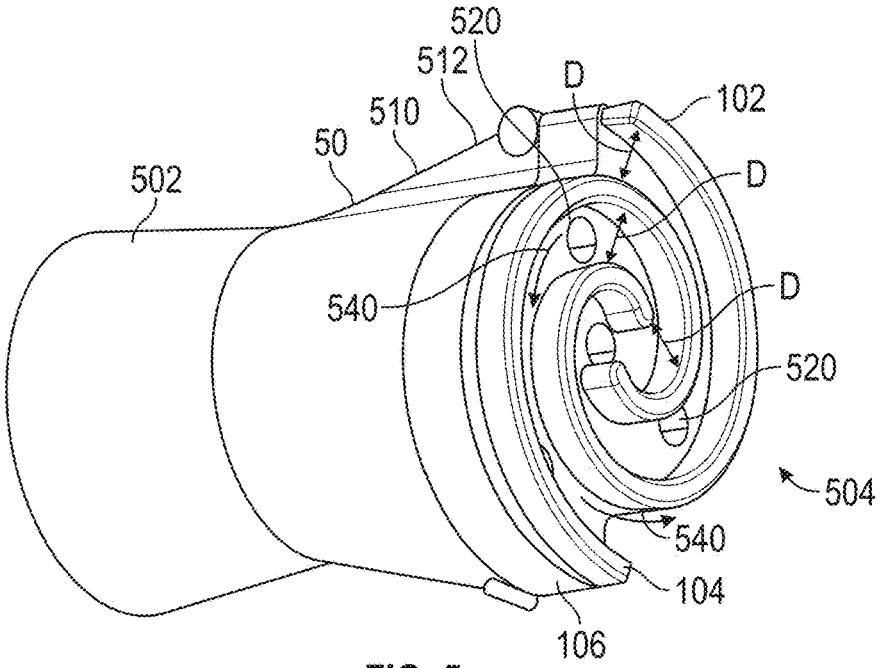
FIG. 5 is a perspective view a drill bit according to one embodiment.

FIG. 5 shows a bit 50 that includes a bit body 502. The body 502 may be formed or any suitable drill bit material and may be formed of metal in one embodiment. The bit 50 includes an insulating layer 106 that electrically separates the body 502 from the electrodes 102, 104. The insulating layer 106 may be formed of Ceramic (e.g. Zirconium-Oxide), Plastic Material (e.g. PEEK, PTFE), Elastomers (Silicon) or insulating composites fiber materials depending on and in alignment with the electrical strength of the formation and/or the drilling fluid, as well as the design of the electrodes. As illustrated, the electrodes 102, 104 are disposed on a face 504 of the bit 50 that is intended to be the forward most point of a drill string while in operation. The face 504 may be defined by insulating layer 106 in one embodiment and the electrodes 102, 104 may extend outwardly from the insulating layer 106. It shall be understood that the electrodes may be on the surface of the insulating layer 106 or may have portions that are embedded therein.

The electrodes 102, 104 are formed of a conductive metal in one embodiment. The electrodes 102, 104 may be connected to any type of pulse generator and the connection may take the form as shown in FIG. 3, for example. Such connections may be made within the body 502. It shall be understood that, in one embodiment, the electrodes 102, 104 may have a protective coating disposed on them or may otherwise be protected from damage due to harsh drilling conditions. Such a coating is generally shown by element 640 in FIG. 6.

The bit body 502 may include an internal passage that allows a drilling fluid to be pumped through it. That fluid may exit the face 504 via jets 520. Such fluid may be directed in outwardly in a spiral direction between the electrodes 102, 104 as indicate by flow arrows 540. This may help clear cuttings caused by discharges between electrodes 102, 104.

As shown, each electrode 102, 104 is formed as a spiral. The two spirals are arranged on the face 504 such that they are at constant distance D from each other at most or all locations on the face. If the electrodes 102, 104 are closer to each other at any particular location a situation where discharge may occur at that location more often than other locations may arise. This may make forming a consistent "cutting" across the face 504 of the bit 50 more difficult to achieve.

In one embodiment, the body 502 may also include a side cutter 510. The side cutter 510 may include a mechanical blade 512 that, due to mechanical interaction between it and surrounding rock causes the rock to be removed. Such side cutters are known and may take the form any known form including, for example, straight or spiraled gauge blades that may be coated or otherwise include very hard cutting elements such as natural or synthetic diamond.

In the following description, electrodes numbered 102 will be positive and those numbered 104 will be negative. Also, to distinguish between locations, portions of an electrode on the face of the bit will have a suffix "a" and those surrounding the body will have a suffix "b" even though they are one continuous electrode. For example, reference number 102*a* will refer to a face located portion of electrode 102 and reference number 102*b* will refer to body located portions of electrode 102.

Figure 6:
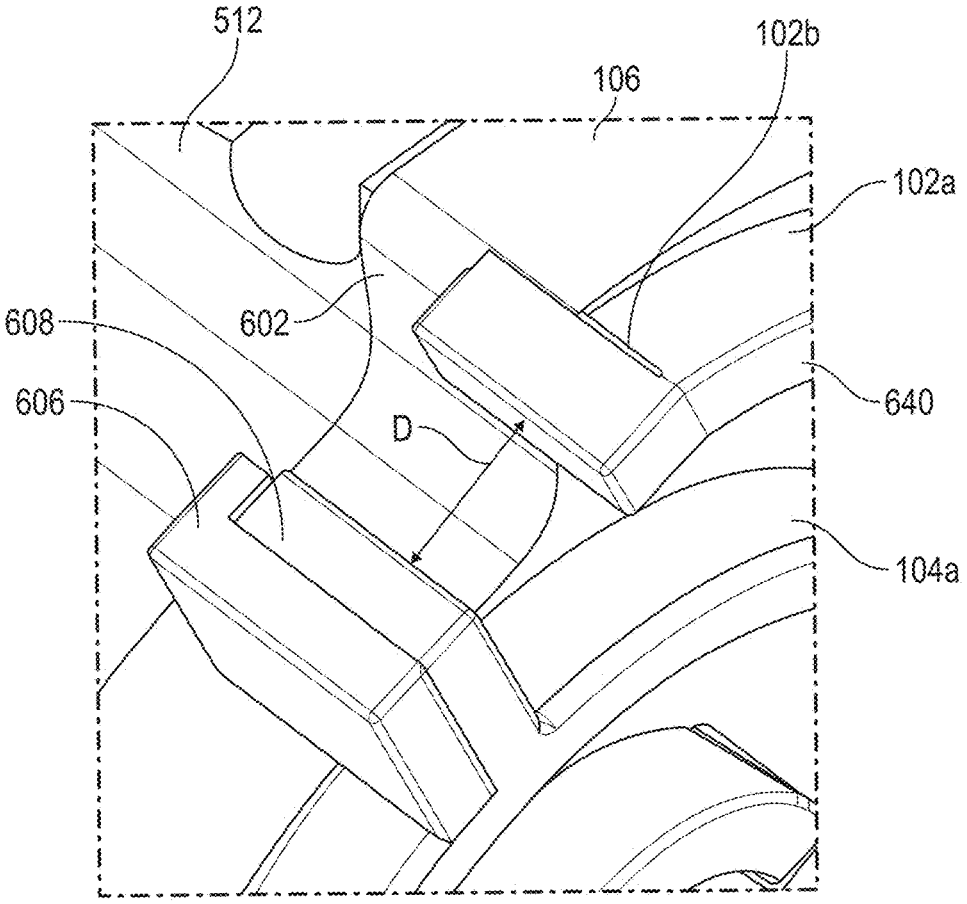
FIG. 6 shows a portion of alternative drill bit according to another embodiment.

In another embodiment, and with reference now to FIG. 6, a leading edge 602 of the insulating layer 106 or the blade 512 (or both) may have a portion of electrode 102 disposed on it. Such a portion is called a first side cutting electrode herein and shown as element 102*b* in FIG. 6. The insulating layer 106 may include an extension 606 that extends radially outward and supports a second side cutting electrode 104*b* that is an extension of the second electrode 104*a*. The first and second side cutting electrodes 604, 608 are also separated by a distance D and serve to cut rock located lateral to the drill bit in the same manner as described above relative to the face.

Figure 7:
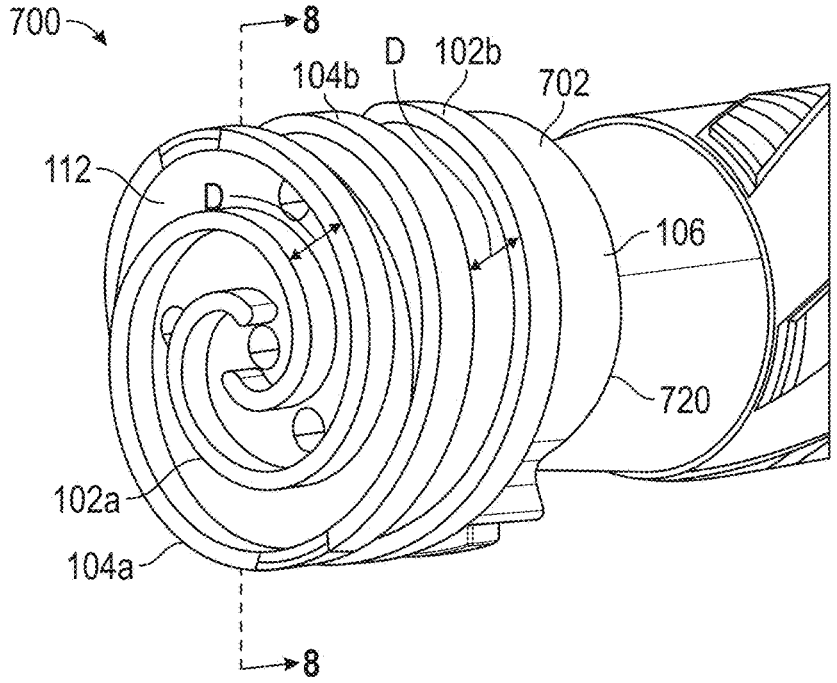
FIG. 7 shows helical spiral electrodes surrounding a radial outer surface of the insulating layer of a drill bit according to one embodiment.

In another embodiment, and with reference now to FIG. 7, a bit 700 includes helical spiral electrodes 102, 104 that surround a radial outer surface 702 of the insulating layer 106 that surrounds an outer perimeter of the drill bit 700. In such a case, the portions of the electrodes 102, 104 (102*a*/104*b*) disposed on this outer surface 702 may also be separated by the same distance D which they are separated on the face 112 or the blade 512 (or both). The portion of the first electrode 102 that surrounds surface 702 is referred to as a first side cutting electrode 102*b* and the portion of the second electrode 104 that surrounds surface 702 is referred to as a second side cutting element 104*b*. The first and second side cutting electrodes 102*b*, 104*b* are also separated by a distance D and serve to cut rock located lateral to the drill bit in the same manner as described above relative to the face.

Figure 8:
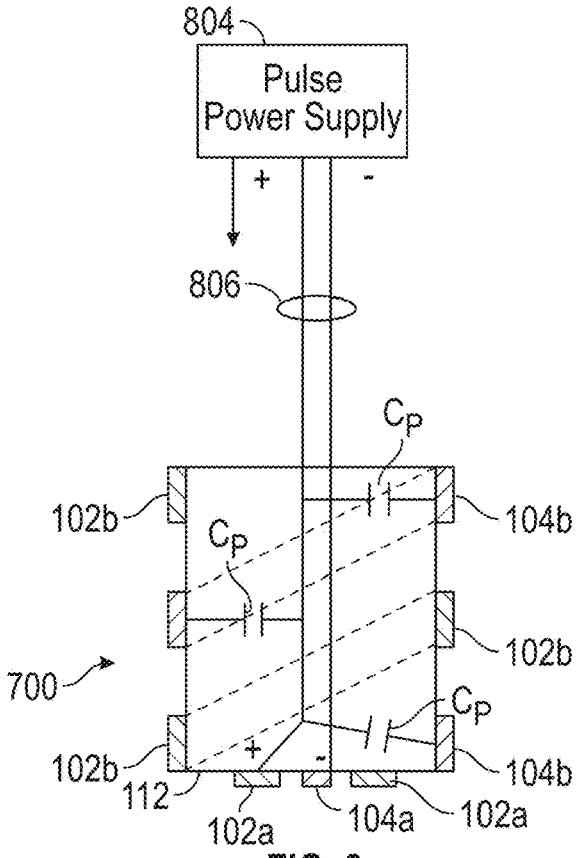
FIG. 8 shows a cross section taken along line 8-8 of FIG. 7 and an additional pulse power supply unit.

FIG. 8 shows a cross section taken along line 8-8 of FIG. 7 and an additional pulse power supply unit 804. The power supply unit 804 can be located in the BHA or other location and provides one or more pulses in the manner as described above. In operation, the pulses can be generated by, for example, the circuit shown above in FIG. 3 or that shown in FIG. 9 below. A connector 806 electrically connects the power supply unit 804 to the first electrode 102*a* on the face 112 of the bit. Of course, the connector 806 may but need not, include a direct connection from the power supply 804 to the second, ground electrode 104*a*. The connection shown in FIG. 8 could be utilized for bits in all embodiments disclosed above.

Figure 9:
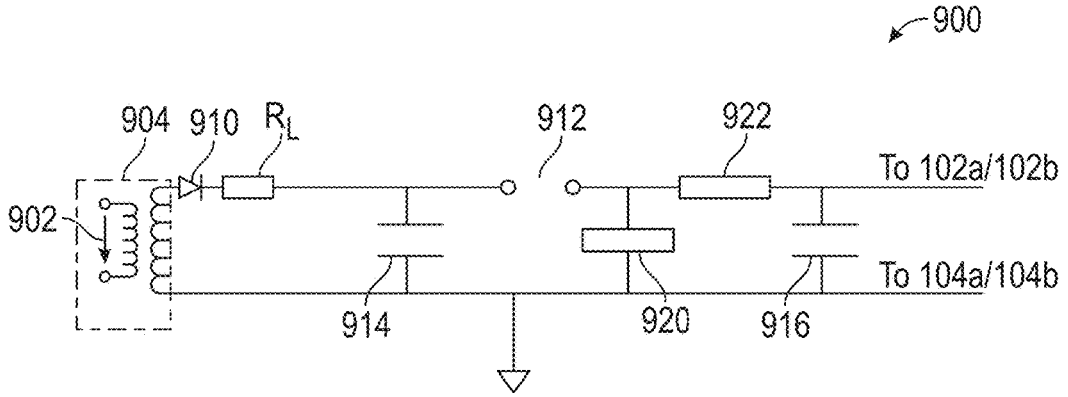
FIG. 9 shows an example of a circuit that may drive any of the embodiments disclosed herein.

In more detail, and now with reference to FIG. 9, the power supply unit 804 has a circuit 900 that includes an input 902 that is provided to a transformer 904. The transformer 904 can transform the voltage provided to a desired level. An optional diode 910 can be provided for isolation.

As described above, the power unit 78 (FIG. 2) can provide an input voltage 902. This voltage causes the one or more high voltage capacitors 914, 916 separated by a spark gap 912 to be charged. When the voltage jumps the spark gap 912, both capacitors 914, 916 can discharge into the electrodes 102, 104. This allows for the electrodes 102, 104 that form the bit capacitor to quickly rise and then discharge through the rock. The timing of the discharges can be controlled based on capacitor values of capacitor 914, 916 and one or more resistors 920, 922 and RL. Capacitor 916 may be referred as a load capacitor and capacitor 914 can be referred to as a surge or spark capacitor herein.

Referring back to FIG. 7, it has been discovered in embodiments where the first and second electrodes 102, 104 include side cutting electrodes 604, 608, that connecting to the face 112 located electrode 102 lead to the formation of parasitic capacitance $C_p$ that can reduce the power or otherwise effect the discharge between the bit electrodes.

Figure 10:
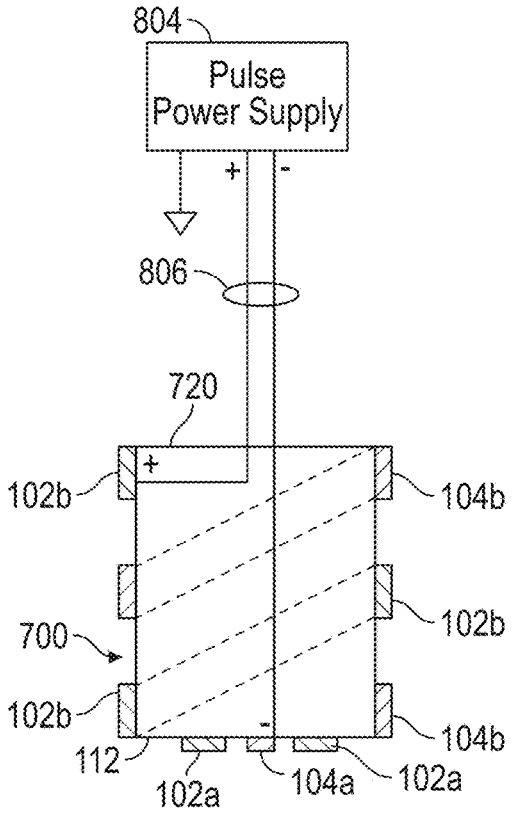
FIG. 10 shows connection of the pulse power supply connected to a different location than that shown in FIG. 8.

In an alternative embodiment, the connector 806 could be connected to the first side cutting electrode 102*b* at or near the back end 720 of the bit 700 as shown in FIG. 10. This will reduce the length of the connector 806 and, thereby, reduce the inductance provided by the conductor. This may also increase room for drilling mud in the bit 700. In this embodiment, the negative portion of the connector 806 is connected to the second side cutting electrode 104*b*

Figure 11:
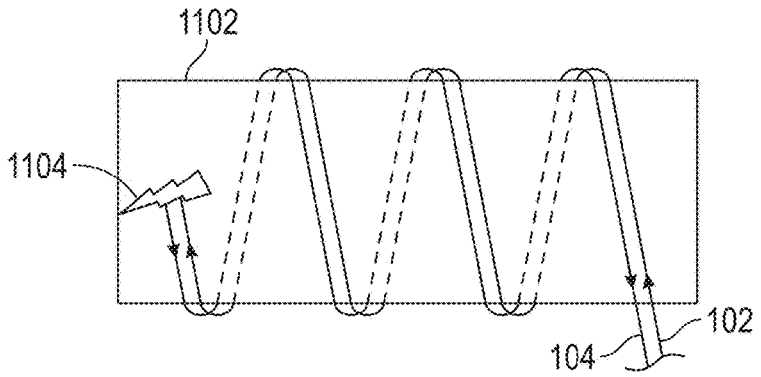
FIG. 11 shows the electrodes arranged such a bifilar coil is formed when a discharge occurs between them.

FIG. 11 shows an alternative embodiment. In this embodiment, rather than having a two separate helical spirals shaped electrodes, the power 102 and ground electrodes 104 can be located near each other as is indicated in FIG. 11. The spacing between them is constant and the two electrodes can be on the sides or face or both of the drill bit 1102. When a discharge occurs (as indicated by spark 1104) the power and ground electrodes behave as a bifilar coil with currents flowing in the directions as indicated on electrodes 102/104. Such a configuration may reduce the inductivity of the electrodes 102/104 as the magnetic fields created in them will cancel each other out.

Figure 12:
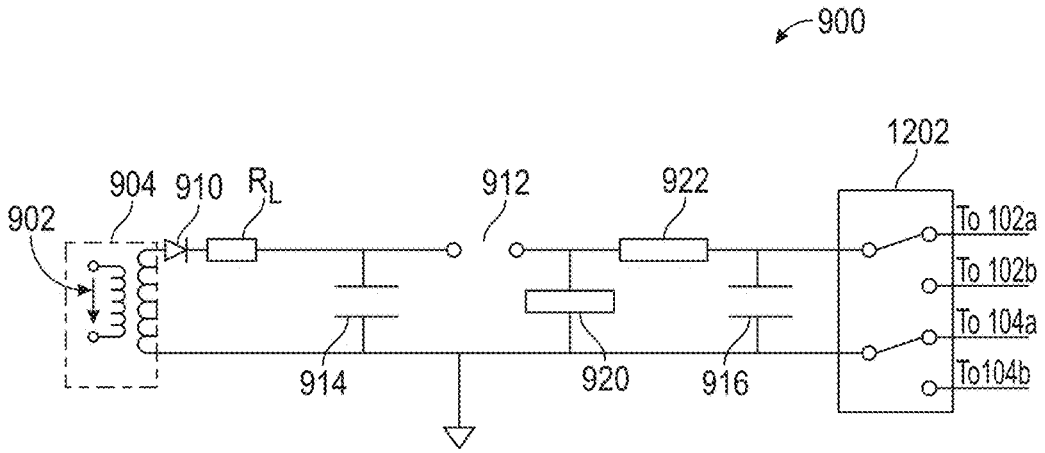
FIG. 12 shows the circuit of FIG. 9 with an additional output toggle element.

With reference to FIG. 12, in another embodiment, the circuit of FIG. 10 could include a toggle or other type of switch 1202 that allows for the power to be delivered to either end of the electrodes. For example, as shown in FIG. 12, the toggle switch 1202 is connecting the circuit to the face electrodes 102*a*, 104*a*. The individual switches in switch 1202 may be insulated gate bipolar transistors or other types of transistors.

Figure 13:
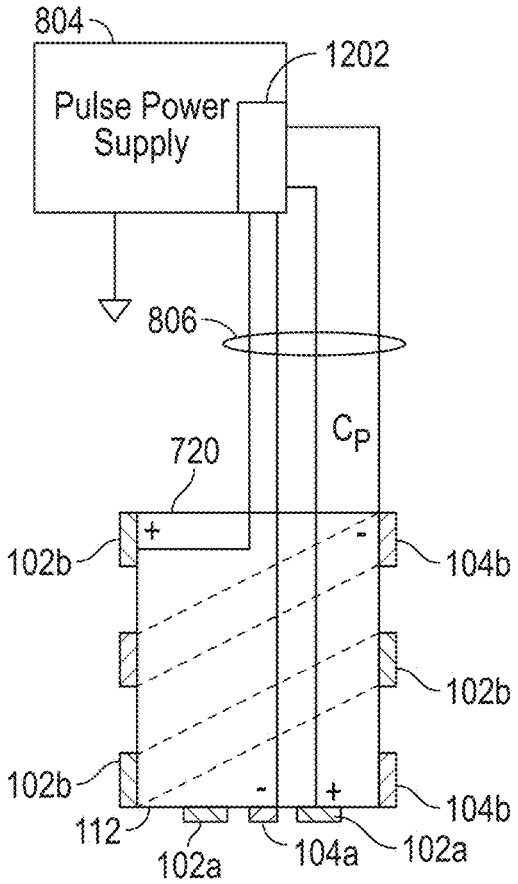
FIG. 13 shows possible configurations of drill bit of FIG. 7 connected to the circuit shown in FIG. 12.

Switching the toggle will allow connections to any configuration of the four possible connection locations (e.g., 102*a*, 102*b*, 104*a*, 104*b*) shown in FIG. 13. The selection of how each switch is configured (e.g., the how the circuit 900 is connected to the bit) can be made randomly or based on performance. The performance can be measured based on logging while drill data, a rate of penetration, fluid analysis, a combination of such information or based on other factors.

Figure 14:
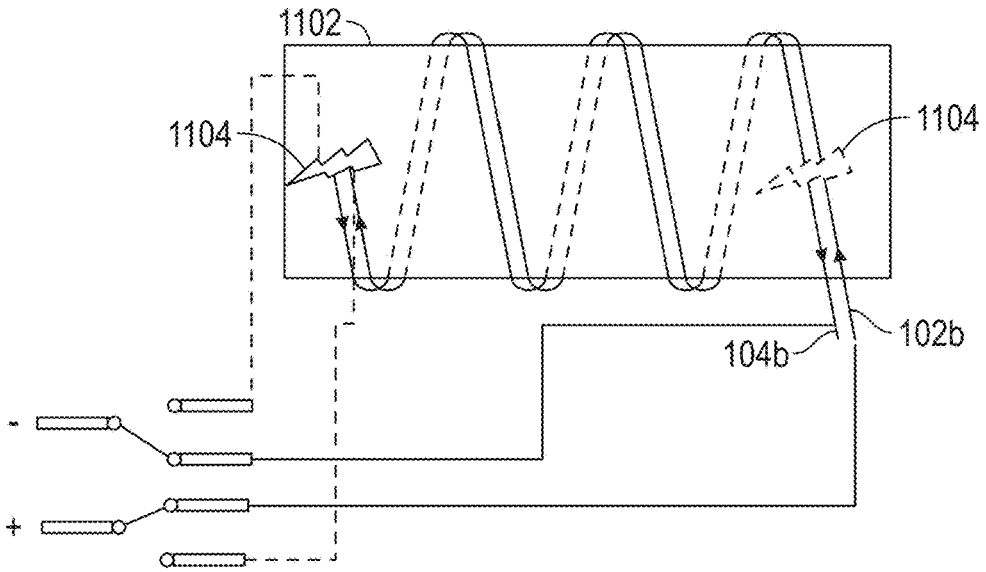
FIG. 14 shows the output toggle element of FIG. 12 connected in two manners to side electrodes implemented as a bifilar coil.

In the previous examples the electrodes have all had a face component 102*a*/104*a*. In one embodiment, only side electrodes may be included as is illustrated in FIG. 14. In such a case, the connections can be made at first end of the side electrodes 102*b*/104*b* as shown by the solid connection lines or the other end as shown by the dashed lines. Or course, other configurations are possible as well.

Embodiment 1

A drill bit assembly includes: a drill bit body; an insulating layer disposed on an end of the drill bit body and that defines a drill bit face; and two electrodes formed such that they both extend from the drill bit face, the two electrodes forming a spiral on the drill bit face and being equidistant from each other at all locations of the drill bit face.

Embodiment 2

The drill bit assembly of any prior embodiment wherein the electrodes form a bifilar coil when a discharge occurs between them.

Embodiment 3

The drill bit assembly of any prior embodiment further comprising: a pulse generator electrically coupled to the two electrodes.

Embodiment 4

The drill bit assembly of any prior embodiment, wherein the pulse generator causes the formation of a potential between the two electrodes.

Embodiment 5

The drill bit assembly of any prior embodiment, wherein the pulse generator causes the potential to be formed at a rise time that is below a threshold rise time.

Embodiment 6

The drill bit assembly of any prior embodiment, wherein the threshold rise time is less than a rise time where the potential will discharge through a fluid between the two electrodes.

Embodiment 7

The drill bit assembly of any prior embodiment, wherein the threshold rise time is equal to a rise time where the potential will discharge through a rock near or between the two electrodes.

Embodiment 8

The drill bit assembly of any prior embodiment, further comprising: a power unit that provides power to the pulse generator.

Embodiment 9

The drill bit assembly of any prior embodiment, wherein the power unit is one of a battery, turbine or a mud motor.

Embodiment 10

The drill bit assembly of any prior embodiment, wherein the two electrodes surround a radial outer surface of the insulating layer.

Embodiment 11

The drill bit assembly of any prior embodiment, wherein the two electrodes are equidistant from each other at all locations of the drill bit face and the radial outer surface.

Embodiment 12

The drill bit assembly of any prior embodiment, wherein the pulse generator includes a toggle switch that allows for the potential to be provided either end of the both electrodes.

Embodiment 13

A drill bit assembly comprising: a drill bit body; an insulating layer disposed around the drill bit body; and two electrodes formed such that they both surround a radial outer surface of the insulating layer, the two electrodes forming a helical shape about the radial outer surface and being equidistant from each other.

Embodiment 14

The drill bit assembly of any prior embodiment, wherein the electrodes form a bifilar coil when a discharge occurs between them.

Embodiment 15

The drill bit assembly of any prior embodiment, further comprising: a pulse generator electrically coupled to the two electrodes that causes the formation of a potential between the two electrodes.

Embodiment 16

The drill bit assembly of any prior embodiment, wherein the pulse generator causes the potential to be formed at rise time that is below a threshold rise time this is less than a rise time where the potential will discharge through a fluid between the two electrodes.

Embodiment 17

The drill bit assembly of any prior embodiment, wherein the two electrodes are equidistant from each other at all locations of a face of the drill bit and the radial outer surface.

Embodiment 18

The drill bit assembly of any prior embodiment, wherein the pulse generator includes a toggle switch that allows for the potential to be provided either end of both electrodes.

Embodiment 19

A method of drilling a borehole comprising: coupling a drill bit assembly to a drill string. The assembly includes: a drill bit body; an insulating layer disposed on an end of the drill bit body and that defines a drill bit face; two electrodes formed such that they both extend form the drill bit, the two electrodes being equidistant from each other at all locations on the drill bit; and a pulse generator electrically coupled to the two electrodes. The method also includes: forming a potential between the two electrodes by providing power to the pulse generator; allowing the potential to discharge through a formation at or near the drill bit face; and removing formation fragments from the borehole caused by the discharge.

Embodiment 20

The method of any prior embodiment, wherein the pulse generator causes the potential to be formed at a rise time that is below a threshold rise time.

Embodiment 21

The method of any prior embodiment, wherein the threshold rise time is less than a rise time where the potential will discharge through a fluid between the two electrodes.

Embodiment 22

The method of any prior embodiment, wherein the threshold rise time equal to a rise time where the potential will discharge through a rock near or between the two electrodes.

Embodiment 23

The method of any prior embodiment, further comprising: switching a configuration of a switch in the pulse generator to change a location where the pulse generator provides forms the potential.

In support of the teachings herein, various analyses and/or analytical components may be used, including digital and/or analog systems. The system may have components such as a processor, storage media, memory, input, output, communications link (wired, wireless, pulsed mud, optical or other), user interfaces, software programs, signal processors (digital or analog) and other such components (such as resistors, capacitors, inductors and others) to provide for operation and analyses of the apparatus and methods disclosed herein in any of several manners well-appreciated in the art. It is considered that these teachings may be, but need not be, implemented in conjunction with a set of computer executable instructions stored on a computer readable medium, including memory (ROMs, RAMs), optical (CD-ROMs), or magnetic (disks, hard drives), or any other type that when executed causes a computer to implement the method of the present invention. These instructions may provide for equipment operation, control, data collection and analysis and other functions deemed relevant by a system designer, owner, user or other such personnel, in addition to the functions described in this disclosure.

One skilled in the art will recognize that the various components or technologies may provide certain necessary or beneficial functionality or features. Accordingly, these functions and features as may be needed in support of the appended claims and variations thereof, are recognized as being inherently included as a part of the teachings herein and a part of the invention disclosed.

While the invention has been described with reference to exemplary embodiments, it will be understood by those skilled in the art that various changes may be made and equivalents may be substituted for elements thereof without departing from the scope of the invention. In addition, many modifications will be appreciated by those skilled in the art to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A drill bit assembly comprising:

a drill bit body;

an insulating layer disposed on an end of the drill bit body and that defines a drill bit face; and two electrodes formed such that they both extend from the drill bit face, wherein a first electrode of the two electrodes forms a first spiral on the drill bit face and a second electrode of the two electrodes forms a second spiral on the drill bit face;

wherein a minimum distance between the first spiral and second spiral is identical at all locations along the first and second spirals.

2. The drill bit assembly of claim 1, wherein the two electrodes form a bifilar coil when a discharge occurs between them.

3. The drill bit assembly of claim 1, further comprising:

a pulse generator electrically coupled to the two electrodes.

4. The drill bit assembly of claim 3, wherein the pulse generator causes the formation of a potential between the two electrodes.

5. The drill bit assembly of claim 4, wherein the pulse generator causes the potential to be formed at a rise time that is below a threshold rise time.

6. The drill bit assembly of claim 5, wherein the threshold rise time is less than a rise time where the potential will discharge through a fluid between the two electrodes.

7. The drill bit assembly of claim 5, wherein the threshold rise time is equal to a rise time where the potential will discharge through a rock near or between the two electrodes.

8. The drill bit assembly of claim 4, further comprising:

a power unit that provides power to the pulse generator.

9. The drill bit assembly of claim 8, wherein the power unit is one of a battery, turbine or a mud motor.

10. The drill bit assembly of claim 1, wherein the two electrodes also surround a radial outer surface of the insulating layer.

11. The drill bit assembly of claim 4, wherein the pulse generator includes a switch that allows for the potential to be provided either end of the both electrodes.

12. A drill bit assembly comprising:

a drill bit body;

an insulating layer disposed around the drill bit body; and two electrodes formed such that they both extend from a radial outer surface of the insulating layer, wherein a first electrode of the two electrodes forms a first helix on the radial outer surface and a second electrode of the two electrodes forms a second helix on the radial outer surface, wherein a minimum distance between the first helix and the second helix is identical at all locations along the first and second helixes.

13. The drill bit assembly of claim 12, wherein the two electrodes form a bifilar coil when a discharge occurs between them.

14. The drill bit assembly of claim 12, further comprising:

a pulse generator electrically coupled to the two electrodes that causes the formation of a potential between the two electrodes.

15. The drill bit assembly of claim 14, wherein the pulse generator causes the potential to be formed at rise time that is below a threshold rise time that is less than a rise time where the potential will discharge through a fluid between the two electrodes.

16. The drill bit assembly of claim 14, wherein the pulse generator includes a toggle switch that allows for the potential to be provided either end of both electrodes.

17. A method of drilling a borehole comprising:

coupling a drill bit assembly to a drill string, the assembly comprising:

a drill bit body;

an insulating layer disposed on an end of the drill bit body and that defines a drill bit face;

two electrodes formed such that they both extend from the drill bit face, wherein a first electrode of the two electrodes forms a first a spiral on the drill bit face and a second electrode of the two electrodes forms a second spiral on the drill bit face and a minimum distance between the first spiral and second spiral is identical at all locations along the first and second spirals;

and a pulse generator electrically coupled to the two electrodes;

forming a potential between the two electrodes by providing power to the pulse generator;

allowing the potential to discharge through a formation at or near the drill bit face; and removing formation fragments from the borehole caused by the discharge.

18. The method of claim 17, wherein the pulse generator causes the potential to be formed at a rise time that is below a threshold rise time.

19. The method of claim 18, wherein the threshold rise time is less than a rise time where the potential will discharge through a fluid between the two electrodes.

20. The method of claim 18, wherein the threshold rise time is equal to a rise time where the potential will discharge through a rock near or between the two electrodes.

21. The method of claim 17, further comprising:

switching a configuration of a switch in the pulse generator to change a location where the pulse generator forms the potential between the two electrodes.

* * * * *